US009146033B2

(12) United States Patent
Cadima et al.

(10) Patent No.: US 9,146,033 B2
(45) Date of Patent: Sep. 29, 2015

(54) ILLUMINATED KNOBS FOR AN APPLIANCE

(71) Applicant: General Electric Company, Schenectady, NY (US)

(72) Inventors: Paul Bryan Cadima, Prospect, KY (US); Anthony Michael Shaw, Chattanooga, TN (US)

(73) Assignee: General Electric Company, Schenectady, NY (US)

( * ) Notice: Subject to any disclaimer, the term of this patent is extended or adjusted under 35 U.S.C. 154(b) by 248 days.

(21) Appl. No.: 13/747,542

(22) Filed: Jan. 23, 2013

(65) Prior Publication Data

US 2014/0204557 A1 Jul. 24, 2014

(51) Int. Cl.
*F21V 33/00* (2006.01)
*F24C 7/08* (2006.01)

(52) U.S. Cl.
CPC ..... *F21V 33/0044* (2013.01); *F24C 7/082* (2013.01)

(58) Field of Classification Search
CPC ..... F21V 33/0044
See application file for complete search history.

(56) References Cited

U.S. PATENT DOCUMENTS

| | | | | |
|---|---|---|---|---|
| 4,807,091 | A * | 2/1989 | Obata | 362/30 |
| 7,399,936 | B2 | 7/2008 | Hurrle | |
| 2002/0075668 | A1 * | 6/2002 | Dorrie | 362/27 |
| 2007/0193867 | A1 * | 8/2007 | Lorenzo Riera et al. | 200/314 |
| 2012/0243253 | A1 * | 9/2012 | Claprood et al. | 362/555 |

* cited by examiner

*Primary Examiner* — Elmito Breval
(74) *Attorney, Agent, or Firm* — Dority & Manning, P.A.

(57) ABSTRACT

An improved assembly for illuminating knobs on an appliance is provided. Light from a light source is positioned below a surface of the appliance to shine through a light transmissive insert in an aperture in the surface to illuminate a bottom surface of a control knob and/or part of the surface of the appliance. A fluid seal is maintained by the assembly between one side of the appliance surface where the knob is positioned, and an opposing side of the appliance surface where the light source is positioned.

20 Claims, 7 Drawing Sheets

ILLUMINATED KNOBS FOR AN APPLIANCE

FIELD OF THE INVENTION

The subject matter of the present disclosure relates generally to control knobs on an appliance such as a cooking appliance and more specifically to an improved assembly for illuminating the control knobs using a light source disposed under a surface of the appliance.

BACKGROUND OF THE INVENTION

Knobs are commonly used on a variety of commercial and residential appliances to control an operating condition of the appliance. Knobs are particularly common on cooking appliances, such as stoves or cooktops. Various shapes and sizes can be used depending upon e.g., the intended application, aesthetics, and other factors.

For example, cooktops traditionally have at least one heating element positioned at a cooktop surface for use in heating or cooking an object, such as a cooking utensil, and its contents. The at least one heating element may heat a cooking utensil directly through induction heating, or may use another heat source such as electrically resistant coils or gas burners. In gas burner cooktops, air is required for the combustion of the gas fuel. For that reason, some gas burner cooktops have air intake openings to allow for a sufficient amount of air intake to meet the combustion requirements of the gas burners. These openings are sometimes located beneath the knobs. When this is the case, some gas cooktops have lights installed below air intake openings located underneath the knobs so that the light may shine through the openings and communicate certain conditions to the user such as e.g., whether the knob is in an "on" position.

Certain challenges exist with this construction, however. Such construction, for example, may allow for spills or other contaminates to reach, e.g., components positioned below the knob. In the case of an electric cook top appliance, such spills could damage relatively sensitive electrical components.

Accordingly, an improved heating element control assembly that can illuminate a portion of the knob and/or surface such as the surface of a cooking surface while preventing spills or other contaminates from getting below the surface of the appliance would be beneficial.

BRIEF DESCRIPTION OF THE INVENTION

The present disclosure provides an improved assembly for illuminating knobs on an appliance such as a cooking appliance, wherein light from a light source positioned below a surface of the appliance shines through a light transmissive insert in an aperture in the surface to illuminate a bottom surface of a control knob and/or a portion of the surface. The assembly maintains a fluid seal between one side of the surface where the knob is positioned, and an opposing side of the surface where the light source is positioned. Additional aspects and advantages of the invention will be set forth in part in the following description, or may be apparent from the description, or may be learned through practice of the invention.

In one exemplary embodiment, the present disclosure provides an assembly for illuminating knobs on a cooking appliance, including a cooktop surface defining an aperture, and a light transmissive insert positioned at the aperture, where the light transmissive insert defines an insert opening. The assembly also includes a grommet received into the insert opening of the light transmissive insert, where the grommet defines a grommet opening. The assembly also includes a heating element control which includes a stem extending through the grommet opening of the grommet. The grommet forms a fluid seal around the stem, and the heating element control is configured for controlling the amount of heat delivered by a heating element of the cooking appliance. The assembly also includes a light source located below the cooktop surface and proximate to the light transmissive insert. The light source is positioned to direct light through the light transmissive insert. The assembly also includes a control knob positioned on the stem of the heating element control, and the control knob has a bottom surface illuminated by the light source.

In another exemplary embodiment, the present disclosure provides an assembly for illuminating knobs on a cooking appliance, including a cooktop surface defining an aperture, and a first grommet received into the aperture of the cooktop surface, where the first grommet defines a first grommet opening. The assembly also includes a light transmissive insert positioned within the first grommet opening, which forms a fluid seal therewith. The light transmissive insert defines an insert opening. The assembly also includes a second grommet received into the insert opening of the light transmissive insert, where the second grommet defines a second grommet opening. The assembly also includes a heating element control, which includes a stem extending through the second grommet opening of the second grommet insert and forms a fluid seal therewith. The heating element control is configured for controlling a heating element of the cooking appliance. The assembly also includes a light source located below the cooktop surface and proximate to the light transmissive insert, where the light source is positioned to provide light through the light transmissive insert. The assembly also includes a control knob positioned on the stem of the heating element control, where the control knob has a bottom surface illuminated by the light source.

In still another exemplary embodiment, the present disclosure provides an assembly for illuminating knobs on a cooking appliance, including a cooktop surface defining an aperture and a light transmissive insert positioned at the aperture. The light transmissive insert defines an insert opening and the light transmissive insert defines a periphery. The assembly also includes a grommet received into the insert opening of the light transmissive insert, the grommet defining a grommet opening. The assembly also includes a heating element control including a stem extending through the grommet opening of the grommet. The grommet forms a fluid seal around the stem, and the heating element control is configured for controlling the amount of heat delivered by a heating element of the cooking appliance. The assembly also includes a light source located below the cooktop surface and proximate to the light transmissive insert. The light source is positioned to direct light through the light transmissive insert. The assembly also includes a control knob positioned on the stem of the heating element control, the control knob having a bottom surface illuminated by the light source. The control knob has a footprint smaller than the periphery of the light transmissive insert so that light from the light source is visible at said cooktop surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
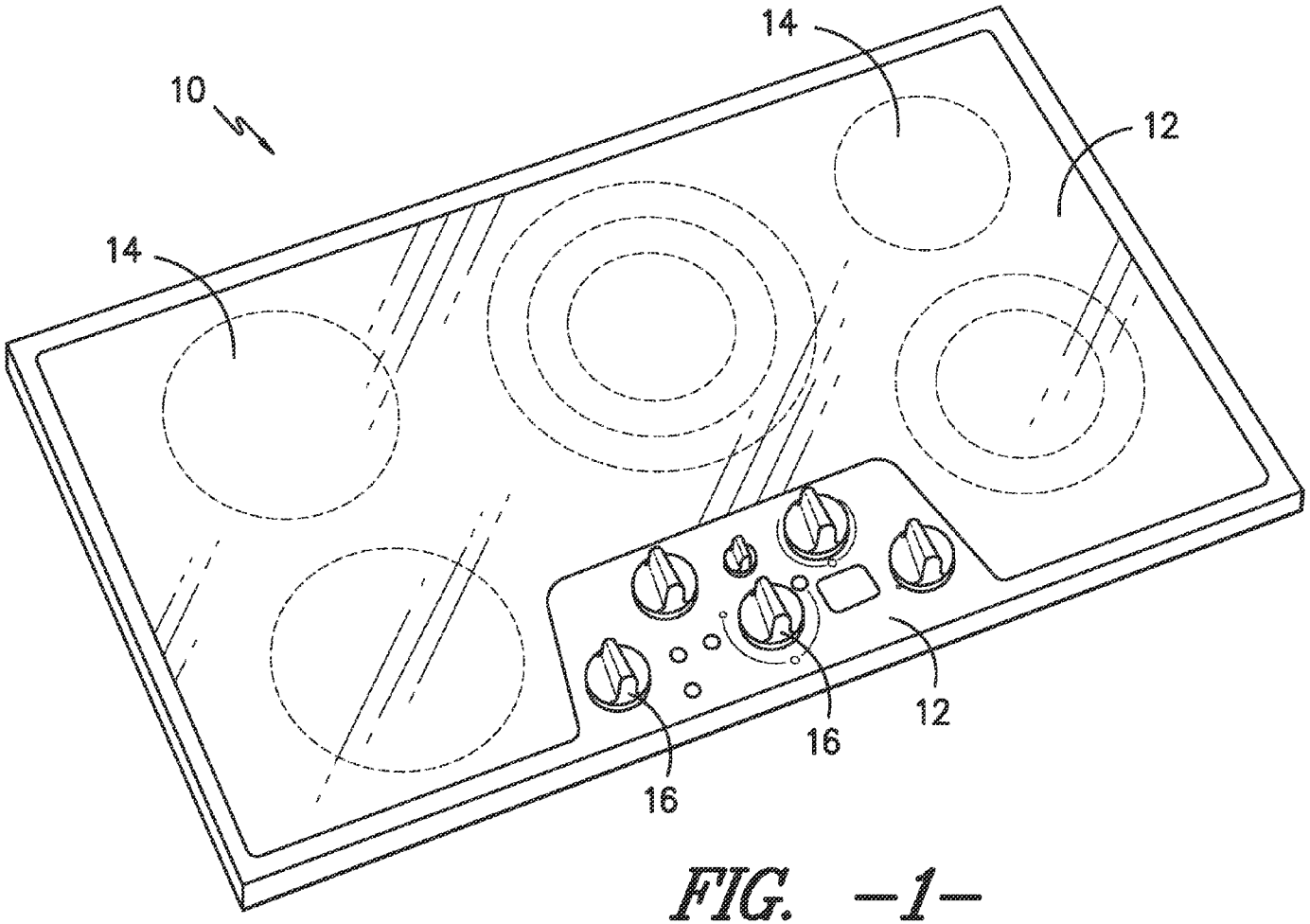
FIG. 1 provides a perspective view of an exemplary embodiment of a cooking appliance of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

The present disclosure relates generally to a system for illuminating knobs on a cooking appliance. FIG. 1 illustrates an exemplary embodiment of a cooking appliance 10 of the present disclosure. Cooking appliance 10 may be, e.g., fitted integrally with a surface of a kitchen counter, or be a part of one or more oven appliances. Cooking appliance 10 can include a chassis (not shown) and a cooktop surface 12 having one or more heating elements 14 for use in, e.g., heating or cooking. In one exemplary embodiment, cooktop surface 12 is comprised of ceramic glass. In other embodiments, however, cooktop surface 12 may be comprised of another suitable material, such as a metallic material (e.g., steel) or other suitable non-metallic material. Heating elements 14 may be various sizes, as shown in FIG. 1, and may employ any suitable method for heating or cooking an object, such as a cooking utensil (not shown), and its contents. In one embodiment, for example, heating element 14 uses a heat transfer method, such as electric coils or gas burners, to heat the cooking utensil. In another embodiment, however, heating element 14 uses an induction heating method to heat the cooking utensil directly.

The amount of heat delivered by each heating element 14 on cooktop surface 12 is controlled by a corresponding heating element control 34 and control knob 16, as is detailed in the exemplary embodiments described below and shown in FIGS. 2 through 7. Knob 16, as used herein, refers to any configuration of rotary dial, and not just one having a circular base, as shown in FIG. 1. For example, the present disclosure contemplates exemplary embodiments wherein knobs 16 have a rectangular base, an ovular base, or any other shape having one or more curved lines, straight lines, or both.

Figure 2:
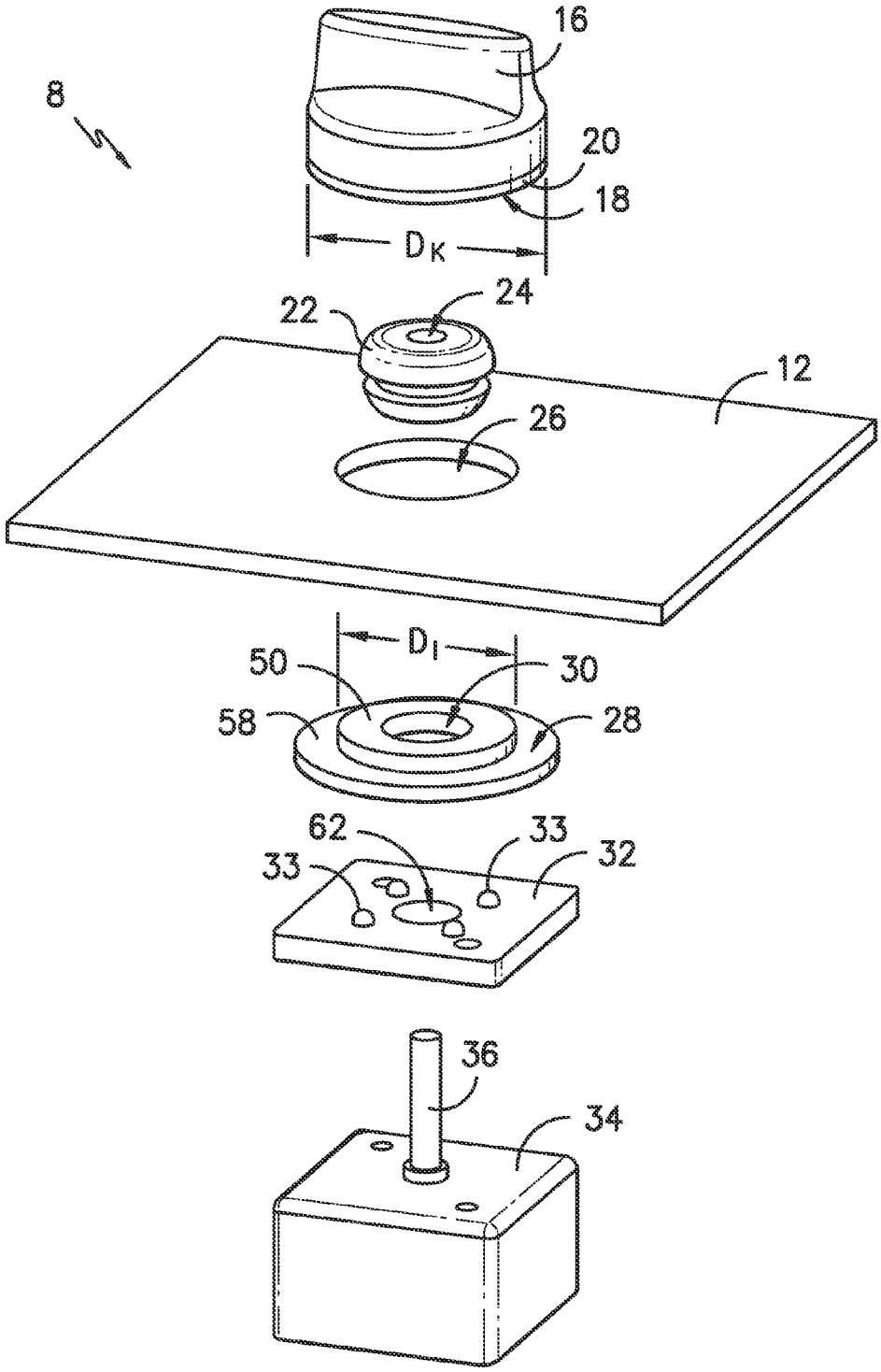
FIG. 2 provides an exploded perspective view of an exemplary embodiment of an illuminating knob assembly of the present disclosure.
Figure 3:
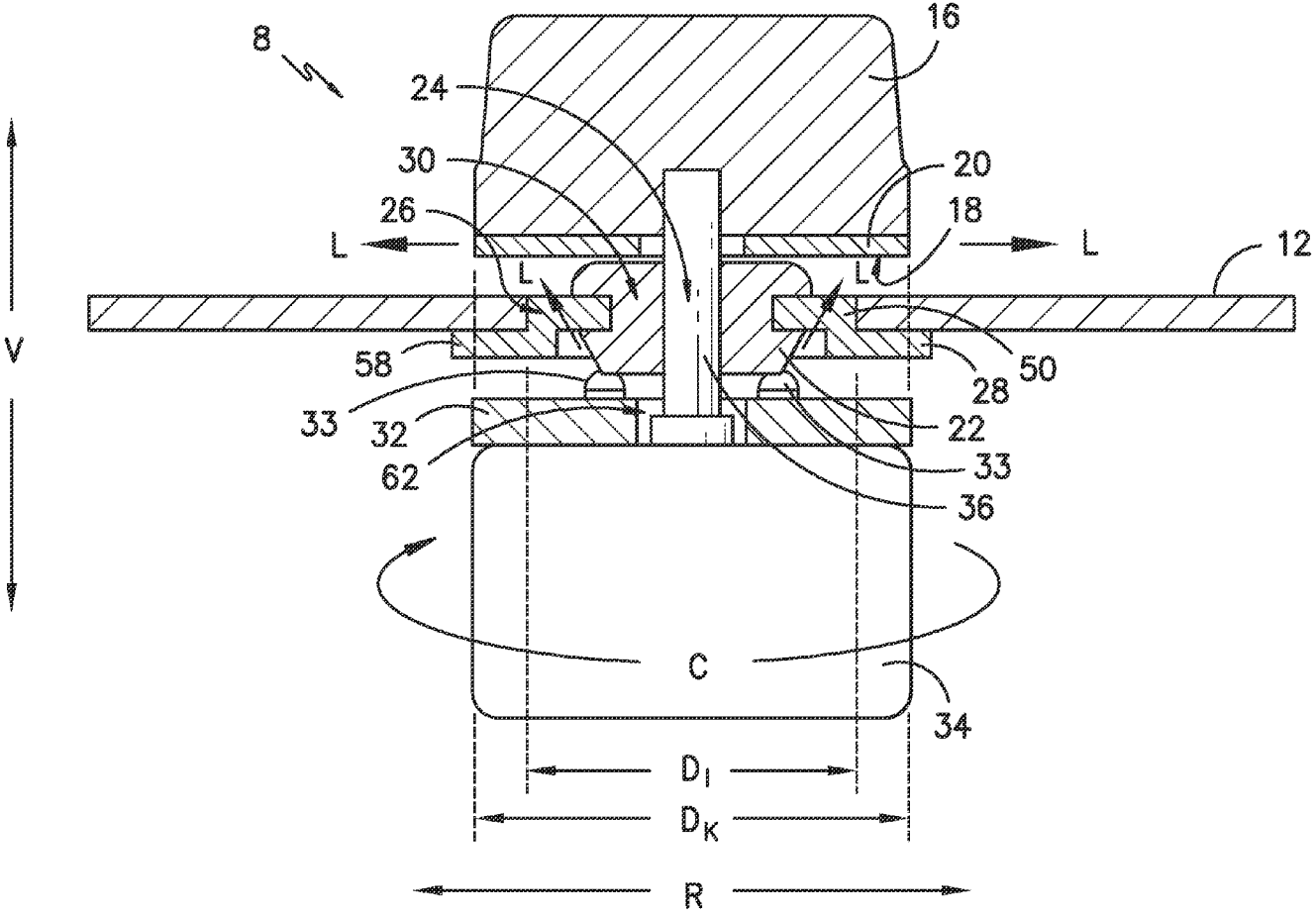
FIG. 3 provides a cross-sectional side view of an exemplary embodiment of an illuminating knob assembly of the present disclosure.

FIGS. 2 and 3 show an exploded perspective view and cross-sectional side view of an exemplary embodiment of an assembly 8 for illuminating knobs 16 on cooking appliance 10. In this embodiment, assembly 8 includes cooktop surface 12, defining an aperture 26. Cooktop surface 12, as used herein, refers to any surface of cooking appliance 10. For example, the present disclosure contemplates exemplary embodiments where the entirety of cooktop surface 12 is comprised of a single suitable material and other embodiments where cooktop surface 12 is comprised of one material proximate to heating elements 14, and another material proximate to knobs 16.

In one exemplary embodiment, assembly 8 also includes a light transmissive insert 28 positioned at aperture 26 in cooktop surface 12, wherein insert 28 defines an insert opening 30. In another exemplary embodiment, insert 28 is comprised of a transparent material, a translucent material, or both. In one exemplary embodiment, insert 28 has a raised portion 50 and a lower flange portion 58. In this embodiment, when insert 28 is positioned in aperture 26, raised portion 50 is substantially flush with cooktop surface 12. In other embodiments, however, insert 28 may have other shapes, such as a flat disc shape. Additionally, insert 28 may be fixed to cooktop surface 12 in any suitable manner, such as by using any suitable binding material.

Still referring to the exemplary embodiment shown in FIGS. 2 and 3, assembly 8 also includes a grommet 22 received into insert opening 30, wherein grommet 22 defines a grommet opening 24. Grommet 22 is comprised of a resilient material, such as a natural or synthetic rubber. Heating element control 34 includes a stem 36 extending through grommet opening 24 of grommet 22. Grommet 22 forms a fluid seal around stem 36, such that grommet 22 forms a fluid seal between insert 28 and stem 36. In the exemplary embodiment shown in FIGS. 2 and 3, stem 36 extends in a vertical direction, V. Additionally, stem 36 is positioned radially inward from grommet 22 in a radial direction, R, while grommet 22 is positioned radially inward from insert 28, and insert 28 is positioned radially inward from cooktop surface 12.

In the exemplary embodiment of FIGS. 2 and 3, assembly 8 also includes a light source 32 located below cooktop surface 12 and proximate to insert 28. Light source 32 is positioned to direct light through insert 28 positioned at aperture 26 in cooktop surface 12 (arrows L). In one exemplary embodiment, light source 32 is configured for illuminating based on one or more operating conditions of heating element 14, cooking appliance 10 (shown in FIG. 1), or both. In another exemplary embodiment, light source 32 is at least one light emitting diode (LED), configured for illuminating as a single color. In still another embodiment, light source 32 is more than one LED and is capable of illuminating in different colors based on one or more operating conditions of heating element 14, cooking appliance 10, or both. However, in other embodiments, light source 32 may be another electrical light source, such as one or more traditional light bulbs.

In yet another exemplary embodiment, light source 32 further defines a light source opening 62. In this embodiment, stem 36 extends through light source opening 62 and light source is positioned between a portion of heating element control 34 and insert 28, as shown in FIGS. 2 and 3. However, in other embodiments, light source 32 may be positioned elsewhere.

For this exemplary embodiment, knob 16 is positioned on stem 36 of heating element control 34, as shown in FIGS. 2 and 3. Knob 16 is fixed to stem 36 such that rotating knob 16 a certain amount in a circumferential direction C rotates stem 36 the same amount in circumferential direction C. Knob 16 has a bottom surface 18 that is illuminated by light source 32 as shown in FIG. 3. For this embodiment, bottom surface 18 of knob 16 is elevated in vertical direction V from cooktop surface 12. However, in other embodiments, knob 16 may be positioned such that bottom surface 18 is not elevated relative to cooktop surface 12.

Knob 16 also includes a light distributing material 20 forming bottom surface 18. Light distributing material 20 is configured to receive light from light source 32 and redirect the light outwardly from knob 16 (arrows L). For example, light distributing material 20 comprises one or more light pipes. Light pipes receive light from a light source and transmit the light along their length in either a tube or rod form and may be bent to match the geometry of bottom surface 18 of knob 16. A particular type or source of light pipe should not be considered limiting or required under the present disclosure.

In the exemplary embodiment shown in FIGS. 2 and 3, knob 16 and insert 28 have circular shapes in radial direction R. Further, raised portion 50 of insert 28 has a circular shape in radial direction R. In this embodiment, raised portion 50 has an effective diameter, $D_I$, in radial direction R that is less than or equal to an effective diameter of knob 16, $D_K$, in radial direction R.

Figure 4:
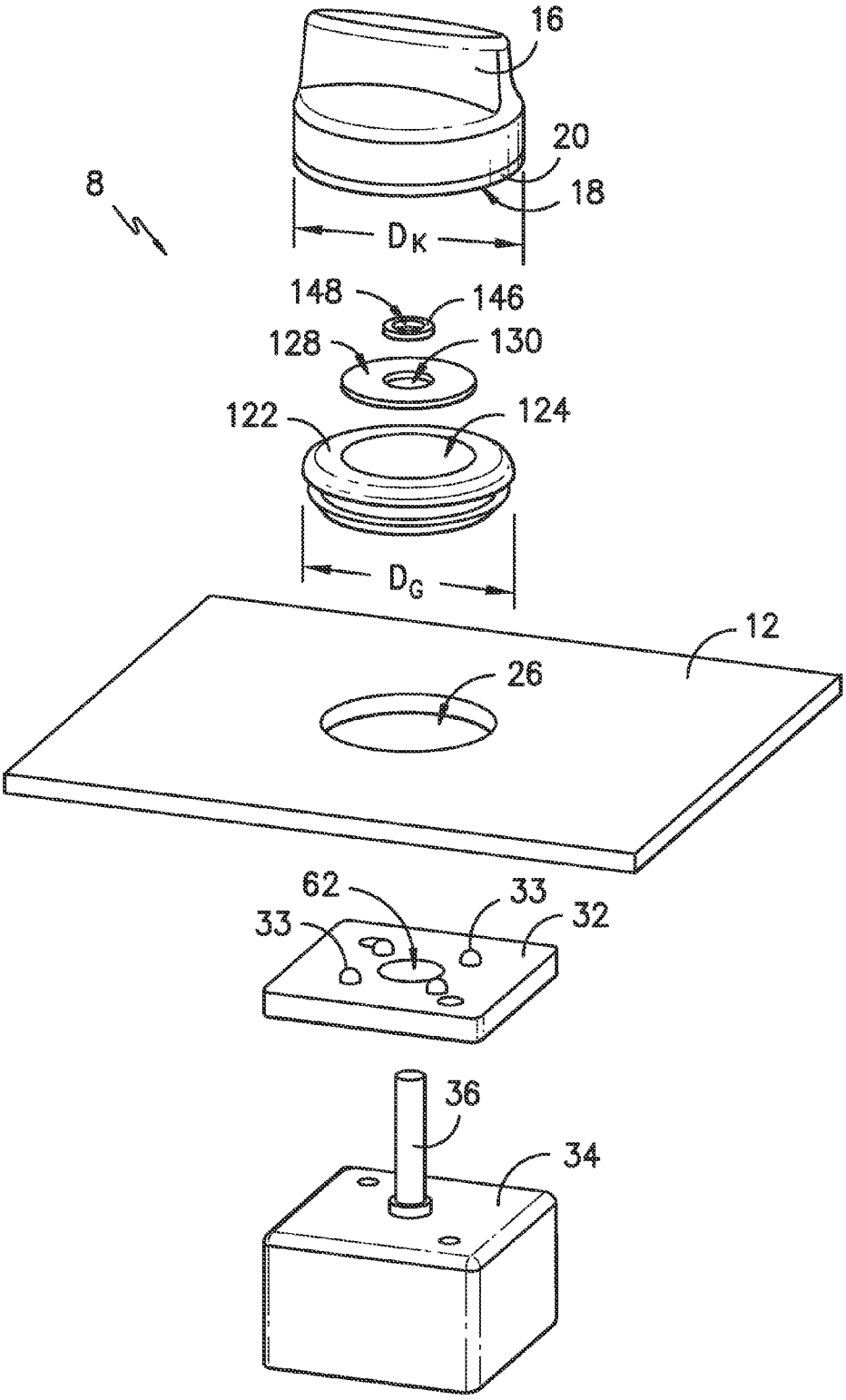
FIG. 4 provides an exploded perspective view of another exemplary embodiment of an illuminating knob assembly of the present disclosure.
Figure 5:
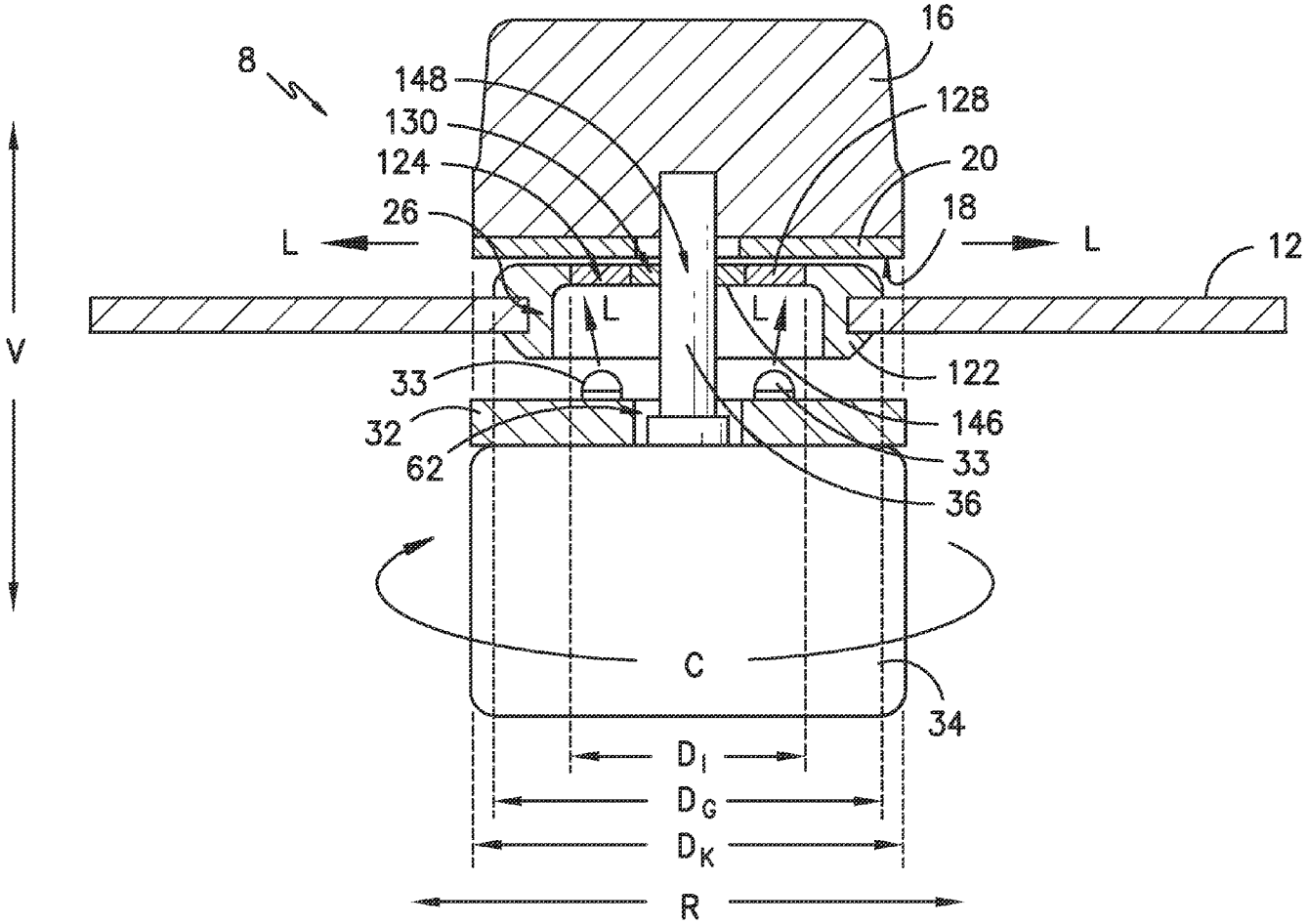
FIG. 5 provides a cross-sectional side view of another exemplary embodiment of an illuminating knob assembly of the present disclosure.

Referring now to FIGS. 4 and 5, another exemplary embodiment of assembly 8 for illuminating knobs 16 on cooking appliance 10 is provided. In this exemplary embodiment, assembly 8 includes cooktop surface 12, defining aperture 26, and a first grommet 122 received into aperture 26 of cooktop surface 12. First grommet 122 defines a first grommet opening 124 and light transmissive insert 128 is positioned in first grommet opening 124. In one exemplary embodiment, insert 128 is comprised of a translucent material, a transparent material, or both. First grommet 28 forms a fluid seal with insert 128, such that first grommet 28 forms a fluid seal between insert 128 and cooktop surface 12. Further, insert 128 defines an insert opening 130 and a second grommet 146 is received into insert opening 130. Second grommet 146 defines a second grommet opening 148. Heating element control 34 is also provided and includes stem 36 extending through second grommet opening 148 of the second grommet 146. Second grommet 146 forms a fluid seal around stem 36, such that second grommet 146 forms a fluid seal between stem 36 and insert 128. In one exemplary embodiment, as shown in FIGS. 4 and 5, stem 36 is radially inward from second grommet 146, second grommet 146 is radially inward from insert 128, insert 128 is radially inward from first grommet 122, and first grommet 122 is radially inward from cooktop surface 12. In another exemplary embodiment, first grommet 122, second grommet 124, or both are comprised of a resilient material, such as a natural or synthetic rubber.

Assembly 8 further includes light source 32 located below cooktop surface 12 and proximate to insert 28. Light source 32 is positioned to direct light through insert 28 positioned at aperture 26 in cooktop surface 12. Positioned on stem 36 is knob 16, including bottom surface 18 illuminated by light source 32.

In the exemplary embodiment shown in FIGS. 4 and 5, knob 16 and insert 128 have circular shapes in radial direction R. In this embodiment, insert 128 has an effective diameter, $D_I$, in radial direction R that is less than the effective diameter, $D_K$, of knob 16 in radial direction R. In another exemplary embodiment, first grommet 122 has an effective diameter, $D_G$, in radial direction R that is less than or approximately equal to the effective diameter, $D_K$, of knob 16. In yet another exemplary embodiment, however, the effective diameter, $D_G$, of first grommet 122 may be greater than the diameter, $D_K$, of knob 16 in radial direction R.

Figure 6:
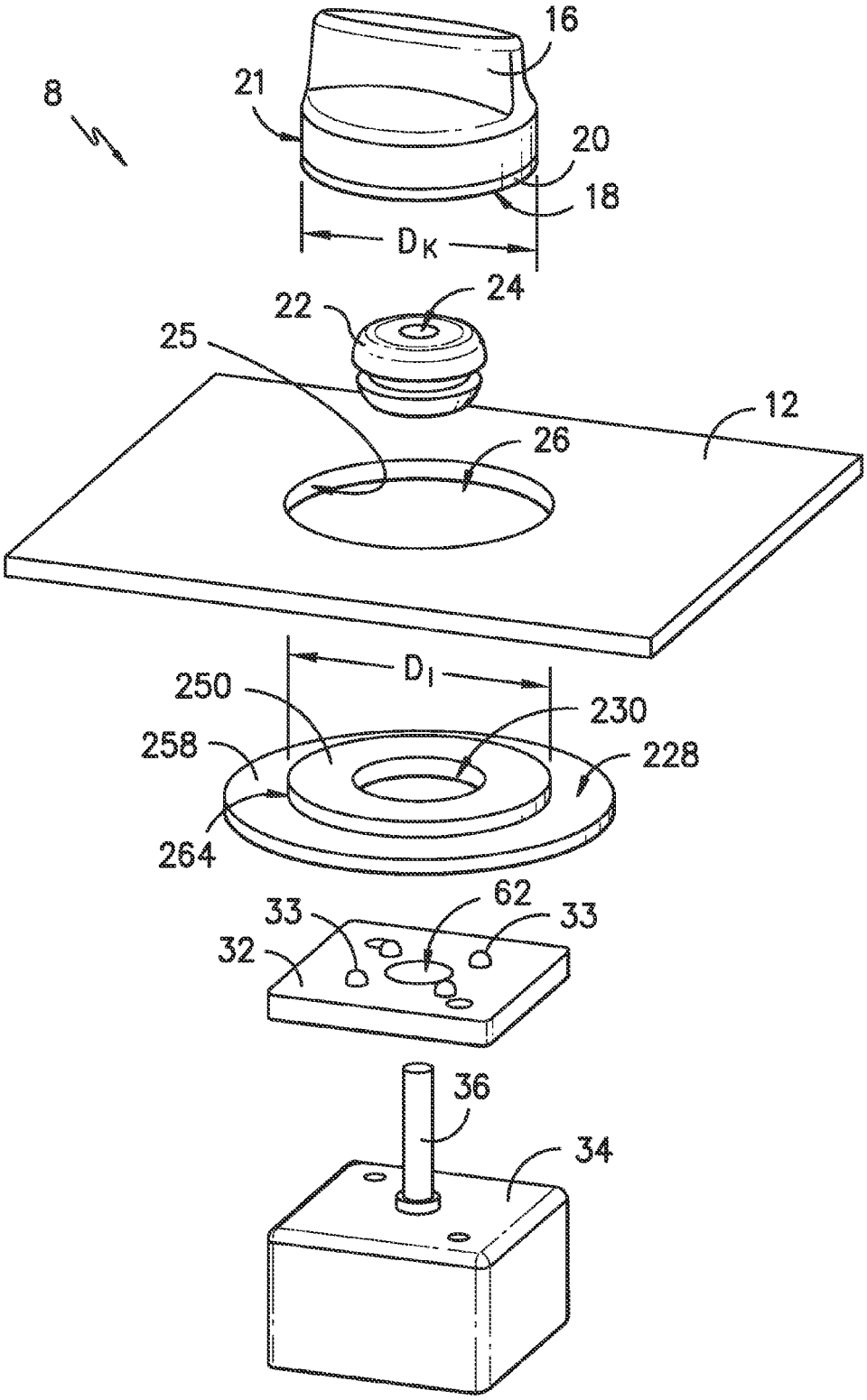
FIG. 6 provides an exploded perspective view of yet another exemplary embodiment of an illuminating knob assembly of the present disclosure.
Figure 7:
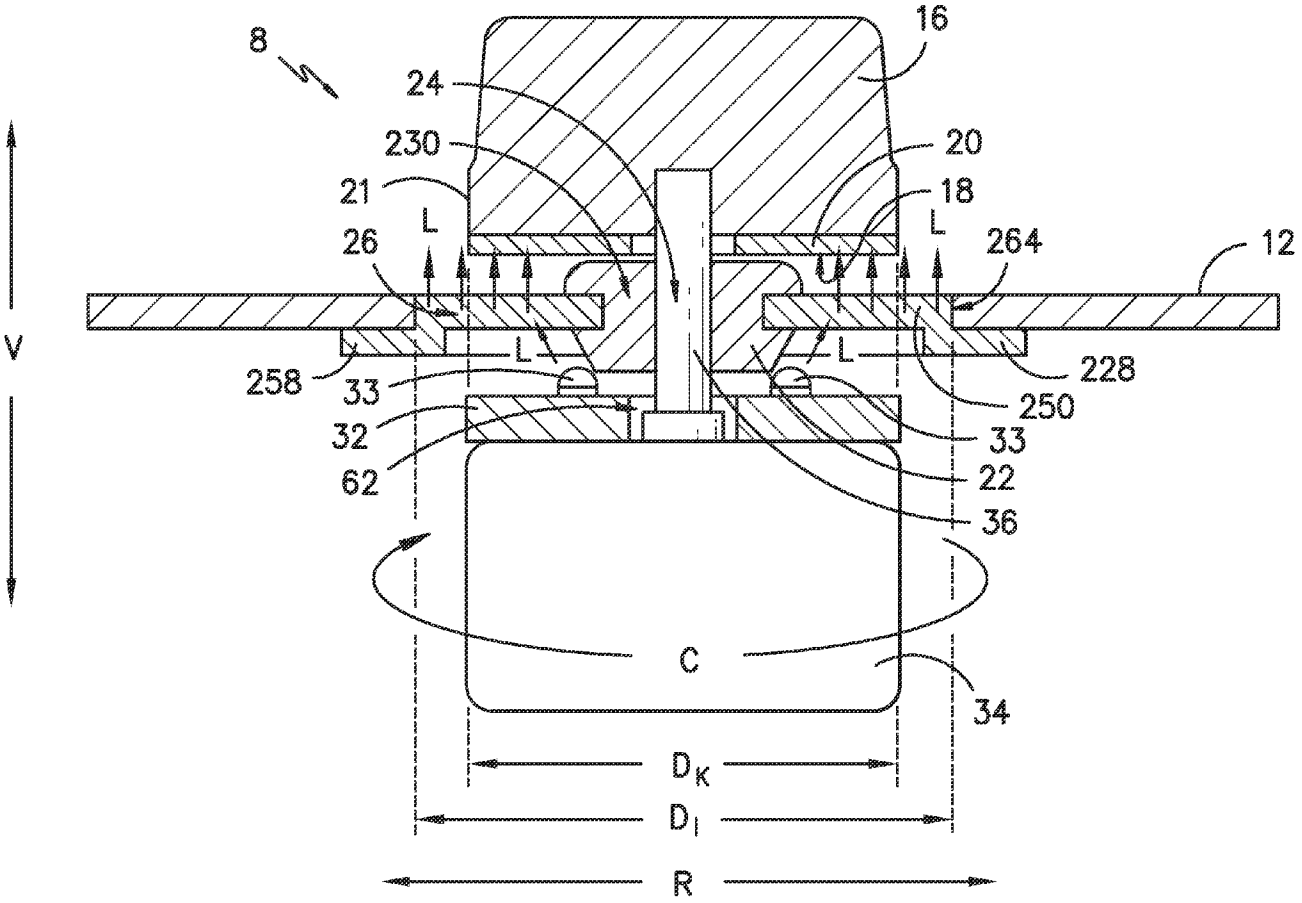
FIG. 7 provides a cross-sectional side view of yet another exemplary embodiment of an illuminating knob assembly of the present disclosure.

Referring now to FIGS. 6 and 7, yet another exemplary embodiment of assembly 8 for illuminating knobs 16 on cooking appliance 10 is provided. In this exemplary embodiment, assembly 8 includes cooktop surface 12 defining aperture 26, and a light transmissive insert 228 positioned at aperture 26, wherein insert 228 defines an insert opening 230 and a periphery 264. Periphery 264 refers to any outer portion of insert 228 that is still radially inward from aperture 26 when insert 228 is positioned at aperture 26. In one exemplary embodiment, insert 228 is comprised of a transparent material, a translucent material, or both. In another embodiment, insert 228 includes a raised portion 250 and a lower flange portion 258. In this embodiment, when insert 228 is positioned in aperture 26, raised portion 250 is substantially flush with cooktop surface 12. Additionally, in this embodiment, periphery 264 is the radially outer portion of raised portion 250, in radial direction R.

In the exemplary embodiment shown in FIGS. 6 and 7, assembly 8 further includes grommet 22 received into insert opening 230 of insert 228, wherein grommet 22 defines grommet opening 24. Heating element control 34 is also provided, including stem 36 extending through grommet hole 24, such that grommet 22 forms a fluid seal around stem 36, such that grommet 22 forms a fluid seal between stem 36 and insert 228.

In this embodiment, assembly 8 additionally includes light source 32 located below cooktop surface 12 and proximate to insert 228, and positioned to direct light through insert 228. Further, knob 16 is positioned on stem 36 of heating element control 34 and has a bottom surface 18 illuminated by light source 32.

In one exemplary embodiment, knob 16 is sized such that it has a footprint that is smaller than periphery 264 of insert 228, so that light from light source 32 is visible at cooktop surface 12. In another exemplary embodiment, knob 16 and raised portion 250 of insert 228 have circular shapes in radial direction R. In this embodiment, an effective diameter, $D_I$, of raised portion 250 of insert 228 would be greater than the effective diameter, $D_K$, of knob 16 in radial direction R.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An assembly for illuminating knobs on a cooking appliance, comprising:

a cooktop surface defining an aperture;

a light transmissive insert positioned at the aperture, said light transmissive insert defining an insert opening;

a grommet received into the insert opening of said light transmissive insert, said grommet defining a grommet opening;

a heating element control including a stem extending through the grommet opening of said grommet, said grommet forming a fluid seal around the stem, said heating element control configured for controlling the amount of heat delivered by a heating element of the cooking appliance;

a light source located below said cooktop surface and proximate to said light transmissive insert, said light source positioned to direct light though said light transmissive insert; and a control knob positioned on the stem of said heating element control, said control knob having a bottom surface illuminated by said light source.

2. The assembly for illuminating knobs on a cooking appliance as in claim 1, wherein said light transmissive insert comprises a translucent material, a transparent material, or both.

3. The assembly for illuminating knobs on a cooking appliance as in claim 1, wherein said light source comprises a light emitting diode.

4. The assembly for illuminating knobs on a cooking appliance as in claim 1, further comprising a light distributing material forming the bottom surface of said control knob and configured to receive light from said light source and redirect the light outwardly from said control knob.

5. The assembly for illuminating knobs on a cooking appliance as in claim 1, wherein the bottom surface of said control knob is elevated above said cooktop surface.

6. The assembly for illuminating knobs on a cooking appliance as in claim 1, wherein said cooktop surface comprises a ceramic glass.

7. The assembly for illuminating knobs on a cooking appliance as in claim 1, wherein said grommet comprises a resilient material.

8. An assembly for illuminating knobs on a cooking appliance, comprising:

a cooktop surface defining an aperture;

a first grommet received into the aperture of said cooktop surface, said first grommet defining a first grommet opening;

a light transmissive insert positioned within the first grommet opening and forming a fluid seal therewith, said light transmissive insert defining an insert opening;

a second grommet received into the insert opening of said light transmissive insert, said second grommet defining a second grommet opening;

a heating element control including a stem extending through the second grommet opening of said second grommet and forming a fluid seal therewith, said heating element control configured for controlling a heating element of the cooking appliance;

a light source located below said cooktop surface and proximate to said light transmissive insert, said light source positioned to provide light through said light transmissive insert; and a control knob positioned on the stem of said heating element control, said control knob having a bottom surface illuminated by said light source.

9. An assembly for illuminating knobs on a cooking appliance as in claim 8, wherein said light transmissive insert comprises a translucent material, a transparent material, or both.

10. An assembly for illuminating knobs on a cooking appliance as in claim 8, wherein said light source comprises a light emitting diode.

11. An assembly for illuminating knobs on a cooking appliance as in claim 8, further comprising a light distributing material forming the bottom surface of said control knob and configured to receive light from said light source and redirect the light outwardly from said control knob.

12. An assembly for illuminating knobs on a cooking appliance as in claim 8, wherein the bottom surface of said control knob is elevated above said cooktop surface.

13. An assembly for illuminating knobs on a cooking appliance as in claim 8, wherein said cooktop surface comprises a ceramic glass.

14. An assembly for illuminating knobs on a cooking appliance as in claim 8, wherein said first grommet, said second grommet, or both comprise a resilient material.

15. An assembly for illuminating knobs on a cooking appliance, comprising:

a cooktop surface defining an aperture;

a light transmissive insert positioned at the aperture, said light transmissive insert defining an insert opening, wherein said light transmissive insert defines a periphery;

a grommet received into the insert opening of said light transmissive insert, said grommet defining a grommet opening;

a heating element control including a stem extending through the grommet opening of said grommet, said grommet forming a fluid seal around the stem, said heating element control configured for controlling the amount of heat delivered by a heating element of the cooking appliance;

a light source located below said cooktop surface and proximate to said light transmissive insert, said light source positioned to direct light through said light transmissive insert; and a control knob positioned on the stem of said heating element control, said control knob having a bottom surface illuminated by said light source, said control knob having footprint smaller than the periphery of said light transmissive insert so that light from said light source is visible at said cooktop surface.

16. An assembly for illuminating knobs on a cooking appliance as in claim 15, wherein said light transmissive insert comprises a translucent material, a transparent material, or both.

17. An assembly for illuminating knobs on a cooking appliance as in claim 15, wherein said light source comprises a light emitting diode.

18. An assembly for illuminating knobs on a cooking appliance as in claim 15, further comprising a light distributing material forming the bottom surface of said control knob and configured to receive light from said light source and redirect the light outwardly from said control knob.

19. An assembly for illuminating knobs on a cooking appliance as in claim 15, wherein the bottom surface of said control knob is elevated above said cooktop surface.

20. An assembly for illuminating knobs on a cooking appliance as in claim 15, wherein said cooktop surface comprises a ceramic glass.

* * * * *